United States Patent [19]

Klinger et al.

[11] 4,428,153

[45] Jan. 31, 1984

[54] RECESSED ASTRAGAL FOR DOUBLE DOOR

[75] Inventors: John C. Klinger, Decatur; Grayle S. Nesbit, Stone Mountain, both of Ga.

[73] Assignee: Atlantic Richfield Company, Los Angeles, Calif.

[21] Appl. No.: 355,667

[22] Filed: Mar. 8, 1982

[51] Int. Cl.[3] ..... E05C 7/04

[52] U.S. Cl. ..... 49/366; 49/368; 49/310; 49/313

[58] Field of Search ..... 49/368, 366, 483, 303, 49/310, 311, 312

[56] References Cited

U.S. PATENT DOCUMENTS

| | | | |
|---|---|---|---|
| 1,918,865 | 7/1933 | Purdy . | |
| 3,590,531 | 7/1971 | Childs | 49/368 |
| 4,204,369 | 5/1980 | Hubbard | 49/319 |
| 4,348,836 | 9/1982 | Dumenil et al. | 49/310 X |

*Primary Examiner*—Kenneth Downey
*Attorney, Agent, or Firm*—Jones & Askew

[57] ABSTRACT

A channel is formed between the inner and outer walls in each meeting edge of the doors in a double swinging door installation, and an elongated leaf is pivotably mounted in the channel of each door and extends substantially the full height of its door. Each leaf is pivotable in its channel between a first position adjacent the outer wall of its door where the leaf protrudes out of its channel toward engagement with the leaf of the other door, and a second position away from the outer wall of its door in which the leaf is substantially retracted into its channel. Coil torsion springs urge the leaf of each door toward its retracted position, and a door stop is located in the door frame at the meeting edge portions of the doors for urging the leaves of the doors toward their protruding and engaging positions when the doors are in their closed positions.

4 Claims, 5 Drawing Figures

RECESSED ASTRAGAL FOR DOUBLE DOOR

BACKGROUND OF THE INVENTION

This invention relates to astragals for pivotally mounted double doors of the type that do not include a central vertical support, including panic doors, that allow the opening of either door independently of the other door.

Double doors are commonly used in many commercial buildings, and double "panic" doors are required in many public buildings such as schools, hospitals and the like. The typical panic door includes a horizontal bar-type lever which functions as a latch operator that actuates the latching rods mounted within the meeting stiles of the doors, so as to seat and unseat the latching rods in the recesses in the door sill and in the door header. These doors usually open in one direction only and each door must open independently of the other door.

A double door assembly without the vertical center-post cannot have rigid molding which overlaps from one door to the other if each door is to be opened independently of the other door. The absence of overlapping molding leaves a space between the facing edges of the doors which permits the passage of a tool between the doors and permits the doors when locked to be "picked" or "jimmied" from outside the doors and opened.

Various astragal assemblies have been developed in an effort to make double panic doors more secure, so as to retard and possibly prevent the insertion of a tool between the meeting stiles of the door assembly; however, the prior art astragals usually include an externally mounted structure mounted to the interface of the panic doors, or a structure mounted in a channel at the edge of the meeting stiles of the doors which protrudes from the edges of the doors and is unsightly and unreliable.

SUMMARY OF THE INVENTION

Briefly described, the present invention comprises an astragal assembly for a double panic door which is mounted in recesses formed in the meeting stiles of the doors. Each door includes a leaf pivotably mounted in its recess and extending substantially the entire height of the door. The leaf of each door is arranged to pivot between a position where the leaf is approximately parallel to the plane of its door and protrudes out from its recess toward the opposite door, and a position where the leaf is angled with respect to the plane of its door and retracted within the recess of the door. The pivotable leaf of each door is spring biased to its retracted position when the door is open, and when the doors are moved to their closed position and engage a door stop, the leaves are urged against the bias of their springs to their protruding positions, so that the leaves engage each other and tend to form a seal at the meeting stiles of the door. The leaves are constructed and arranged so that at least one of the leaves abuts the interior surface of its door when the doors are closed and when the leaves are in their protruding positions and each leaf extends in engagement with the leaf of the opposite door. This prevents the leaf from moving beyond its protruding position. When either one or both of the doors are opened, the leaf of the open door retracts in response to the bias of its spring, so that the leaf no longer protrudes from the stile of the door and does not form an undesirable visual or physical protrusion from the door edge.

One of the pivotable leaves of the astragal is formed with a groove extending vertically along the leaf, and the groove faces the opposite door when its door is closed and the leaf is in its protruding position with respect to its own door. The leaf of the other door, when the door is closed and the leaf is in its protruding position, fits into the groove of the leaf of the first door, so that a tongue and groove interfitting relationship is formed by the leaves when the doors are closed. This tongue and groove fit by the leaves in the recesses of the meeting stiles of the doors forms a secure closure between the doors and tends to prevent the penetration of a tool between the doors.

Thus, it is an object of this invention to provide an astragal for a double panic door and the like which is formed in recesses at the meeting stiles of the doors, and which includes inner engaging leaves that pivot between a position where they protrude from one door toward the other door and engage each other when the doors are closed, and a position where the leaves are retracted within the meeting stiles of the doors when the doors are opened so as to avoid protruding from the edges of the doors.

Another object of this invention is to provide an astragal assembly for double panic doors wherein inner engaging leaves are mounted in the meeting stiles of the doors, and when the doors are closed and their leaves are in engagement with each other, the door structure supports the leaves and locates the leaves in their proper tongue and groove fit.

Another object of this invention is to provide a recessed astragal for double panic doors which is formed from a small number of movable elements, which is reliable in operation and which functions to retard the insertion of a tool or other item from outside the door in between the doors.

Other objects, features and advantages of the present invention will become apparent upon reading the following specification, when taken in conjunction with the accompanying drawings.

DETAILED DESCRIPTION

Figure 1:
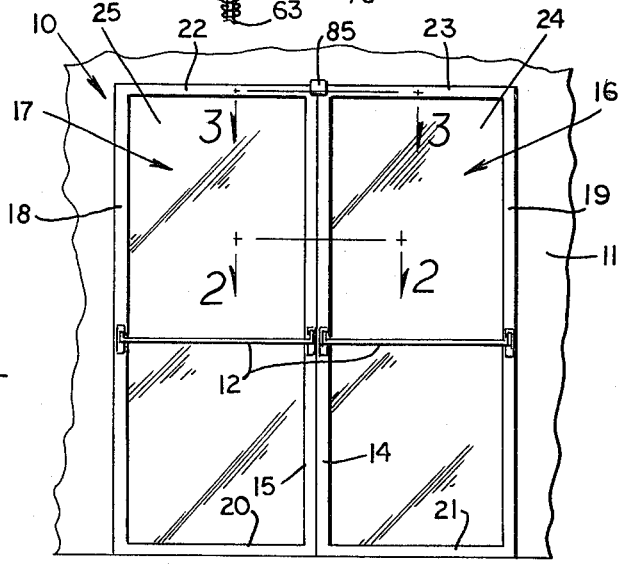
FIG. 1 is a elevational view of the inside surface of a pair of double panic doors, with the doors opening into the drawing.

Referring now in more detail to the drawings, in which like numerals indicate like parts throughout the several views, FIG. 1 illustrates the inside surfaces of a pair of double doors 10 mounted in a door frame 11 of a building structure. The doors illustrated in FIG. 1 generally are referred to as panic doors in that they each include a horizontal latch operator 12 mounted to the stiles of the door, and the doors are arranged to swing outwardly (into drawing FIG. 1) when the latch operators 12 are pushed by a person wishing to pass through the doorway. The doors are hingedly connected to the frame by conventional hinge structures (not shown) and the stiles 14 and 15 meet each other when the doors are closed, as illustrated. The latch rods (not shown) are located internally of the meeting stiles 14 and 15 and engage recesses formed in the door sill and door header (also not shown).

Each door 16 and 17 is formed by the meeting stiles 14 and 15, hinge stiles 18 and 19, lower rails 20 and 21, and upper rails 22 and 23, respectively. The door frames formed by the stiles and rails are filled with glass panels 24 and 25. The hinge stiles, lower rails and upper rails 18–23 of the doors are of conventional construction.

Figure 4:
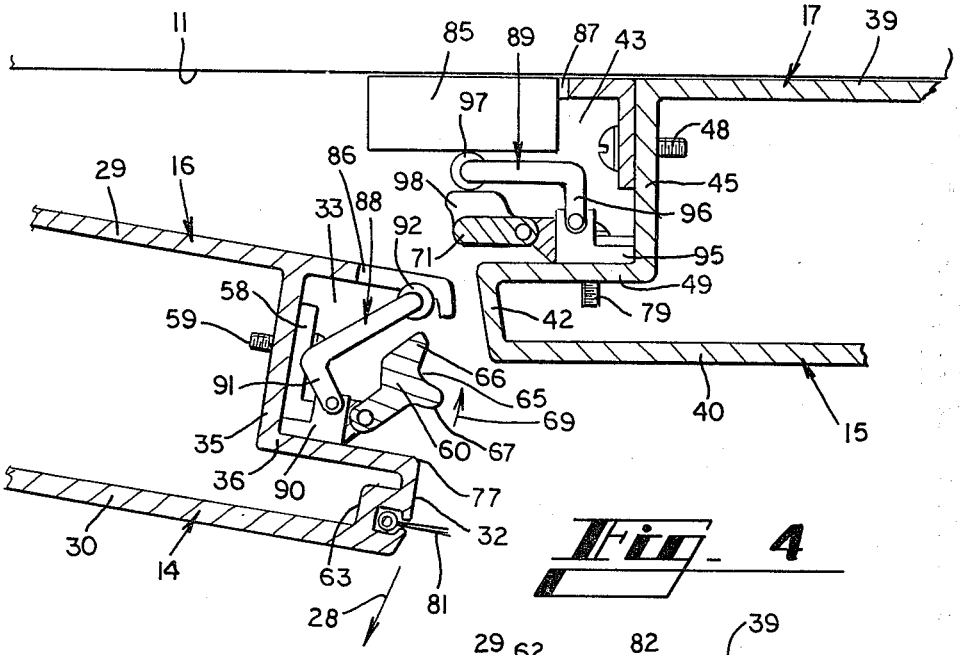
FIG. 4 is a vertical cross-section of the meeting stiles of the double door of FIG. 1, similar to FIG. 3, but showing one of the doors in its open position and the other of the doors in its closed position.
Figure 3:
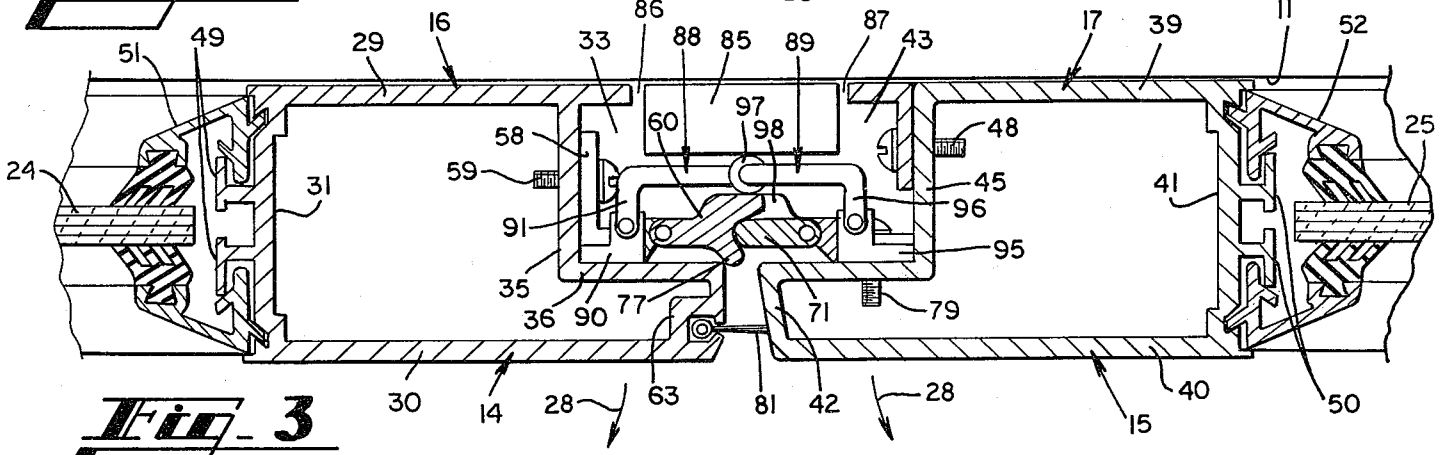
FIG. 3 is a vertical cross-section of the meeting stiles of the doors of FIG. 1, taken along lines 3—3 of FIG. 1, with the doors opening toward the bottom of the drawing.

As illustrated in FIGS. 3 and 4, the upper portions of the meeting stiles 14 and 15 and the upper rails of the doors 16 and 17 are arranged to abut the door frame 11 which is inside the doors, so that the doors are arranged to swing outwardly as indicated by arrows 28 (FIG. 3). Meeting stile 14 includes inner wall 29, outer wall 30, inner peripheral wall 31, and outer peripheral wall 32. A channel or recess 33 is formed between the inner and outer walls 29 and 30 at the outer peripheral wall 32 by the extension 34 of inner wall 29, interior wall 35 and step or shelf wall 36. Likewise, meeting stile 15 includes inner wall 39, outer wall 40, inner peripheral wall 41 and outer peripheral wall 42. A channel 43 is formed by filler wall 44 that functions as an extension of inner wall 39, interior wall 45 and step or shelf wall 46. Filler wall 44 is removably mounted to interior wall 45 by screws 48 or other attachment devices. Each meeting stile includes connector elements 49 and 50 to which the glass molding 51 and 52 and glass panels 24 and 25 can be attached.

Astragal assembly 54 is mounted within the channels 33 and 43 of the meeting stiles 14 and 15 of each door 16 and 17 and includes leaf assemblies 55 and 56 that extend substantially the entire height of the doors and which are each mounted to a door within a channel 33 or 43.

Leaf assembly 55 includes an elongated hinge base 58 that is L-shaped in cross-section, with one leg of the hinge base being rigidly mounted to interior wall 35 by means of screws 59 or other conventional fasteners, and with the other leg positioned in abutment with step 36. Elongated leaf 60 is pivotably mounted to hinge base 58 by means of a series of hinge bosses 61 of the leaf 60 aligned with similar hinge bosses 62 of the hinge base 58 (FIG. 5), and with hinge pin 63 extending through the hinge bosses 61 and 62.

Figure 2:
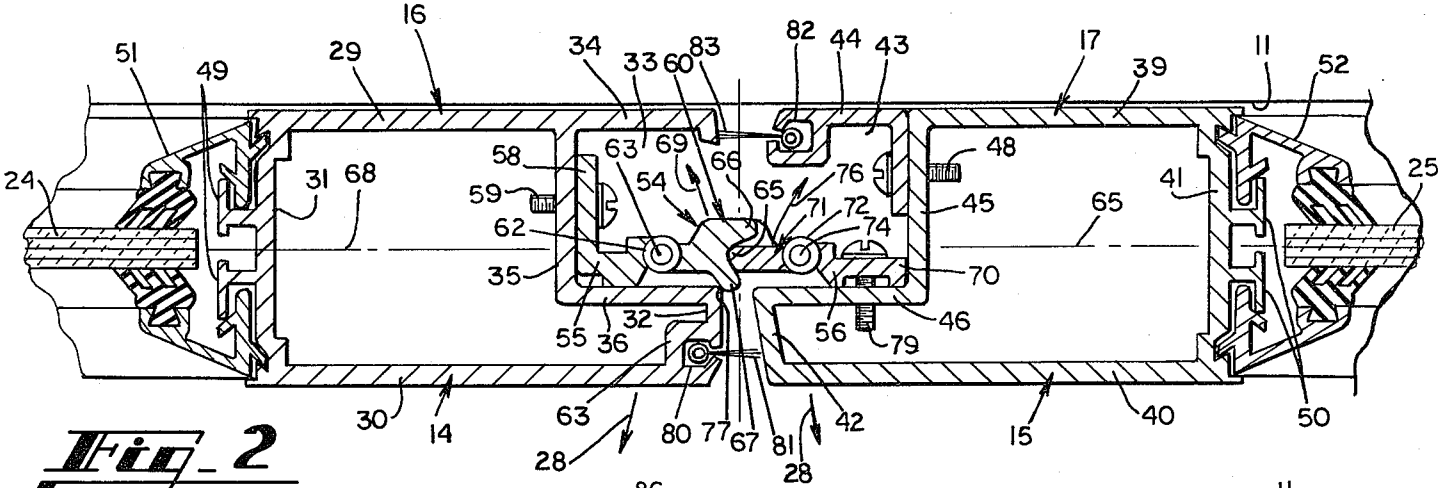
FIG. 2 is a vertical cross-section of the meeting stiles of the doors of FIG. 1, taken along lines 2—2 of FIG. 1, with the inside of the building located at the top of the drawing and the doors opening toward the bottom of the drawing.

Leaf 60 is formed with a groove 65 extending vertically along its length, with arms 66 and 67 straddling the groove 65. Leaf 60 is arranged to pivot from the position illustrated in FIG. 2, where it is substantially parallel to the plane 68 of door 16, in the direction indicated by arrow 69 to a position angled with respect to the plane of the door (FIG. 4). When the leaf 60 is in its position parallel to the plane of the door as illustrated in FIG. 2, the leaf protrudes from channel 33 toward the opposite door 17, and its groove 65 faces the opposite door. When the leaf 60 has been pivoted as illustrated in FIG. 4, the leaf is substantially retracted within the channel of its door.

Figure 5:
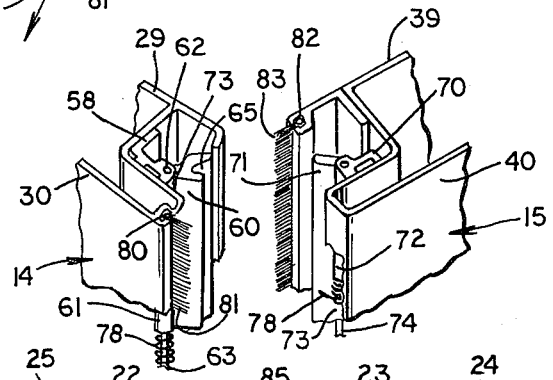
FIG. 5 is a perspective detail illustration, in cross-section, of the double doors of FIG. 1, showing both doors in their opened positions.

As illustrated in FIG. 2, leaf assembly 56 also includes an elongated hinge base 70 that is rigidly mounted to shelf 46 by means of screws 79 or other fasteners, with the hinge base juxtaposed the interior wall 45 of channel 43. As illustrated in FIG. 5, elongated leaf 71 is hingedly mounted to hinge base 70 by a series of hinge bosses 72 of the leaf 71 positioned in spaces between the hinge bosses 73 of the hinge base 70, and with hinge pin 74 extending through the hinge bosses.

Leaf 71 is substantially flat along its length and forms a protruding tongue that is sized and shaped for insertion into the groove 65 of the opposite leaf 60. Leaf 71 is pivotable as indicated by arrow 76 (FIG. 2) from a position substantially parallel to the plane 65 of its door 17 to a position angled with respect to the plane of its door. When the leaf 71 is parallel to the plane of its door as illustrated in FIG. 2, the leaf 71 protrudes from its channel 43 toward the opposite door, and when the leaf is pivoted to its angled position with respect to the plane 65 of its door, the leaf is substantially retracted within its channel (FIG. 5).

It will be noted that both leaves 60 and 71 are positioned adjacent outer walls 30 and 40 of their respective doors and are arranged to pivot from their protruding positions inwardly of their respective channels 33 and 43. Leaf 60 is arranged to abut the corner 77 formed between outer peripheral wall 32 and step 36 when in its protruding position. This arrangement forms a stop surface of the leaf 60 and prevents the leaf from moving beyond its position where it is parallel to the plane of its door. When the opposite leaf 71 is received in the groove 65 of leaf 60, leaf 71 is also prevented from moving further beyond its parallel position with respect to the plane of its door by the tongue and groove fit. One or more coil torsion springs 78 (FIG. 5) are wrapped around each hinge pin 63 and 74 so as to urge the leaves 60 and 71 in the directions indicated by arrows 69 and 76 (FIG. 2), from their protruding positions toward their retracted positions, respectively.

Outer peripheral wall 32 of door 16 defines a slot 80 extending vertically along its length, and a brush or "pile" 81 is supported within the slot and projects toward the opposite door surfaces. Likewise, a slot 82 is formed in the outer edge portion of filler wall 44 of door 17, and a pile 83 is held in the slot. When the doors are closed piles 81 and 83 reduce the flow of air between the meeting stiles of the door and reduce the passage of light therebetween.

As illustrated in FIGS. 1, 3 and 4, a strike plate 85 is located in the paths of the meeting stiles 14 and 15 of the doors and is mounted on the door frame 11 at the door header. The upper ends of the meeting stiles 14 and 15 each define a notch 86 and 87 so that when the doors 16 and 17 are closed against the door frame 11, the notches 86 and 87 register with the strike plate 85 and close about the strike plate. Cam assemblies 88 and 89 are mounted at the upper end of each channel 33 and 43. Cam assembly 88 includes hinge block 90, L-shaped cam arm 91 is pivotally mounted thereto, and Nylon cam pad 92 is mounted in the end of cam pad 91. Cam pad 92 is arranged to engage the upper end of arm 66 of elongated leaf 60, and to engage strike plate 85 of the door frame 11 when the door is moved to its closed position. When cam pad 92 engages strike plate 85, it urges leaf 60 against the bias of its spring from the position illustrated in the left portion of FIG. 4 to the position illustrated in the left portion of FIG. 3, moving the leaf 60 from its retracted position within channel 33 to its protruding position where it protrudes out of channel 33 toward the stile 15 of the opposite door 17.

Likewise, cam assembly 89 includes hinge block 95 and L-shaped cam arm 96 pivotally mounted to hinge block 95, with Nylon cam pad 97 mounted in the distal end of the cam arm 96. The upper end portion of the elongated leaf 71 is enlarged at 98 so that the outer surface of the enlargement is approximately in the same plane as the outer surface of arm 66 of leaf 60, so as to form a cam surface against which cam pad 97 works. When door 17 is moved from its opened position to its closed position, cam pad 97 engages strike 85 and pushes against the cam surface of enlargement 98 of leaf 71, causing leaf 71 to pivot against the bias of its spring 78 and move from its retracted position (FIG. 5) to its protruding position (FIGS. 3 and 4).

It will be noted that the elongated leaves 60 and 71 of the astragal form a tongue and groove fit when the doors 16 and 17 are closed, and when the door 16 is closed the leaf 60 is juxtaposed the corner 77 formed adjacent the outer peripheral wall 32 of the stile 14, which limits further pivoting movement of either leaf 60 and 71. This causes the leaf 60 to assume a predetermined position when the doors are closed, and any force applied to the leaves from the inside of the doors toward the outside is resisted by the abutment of the leaf 60 against corner 77. Additionally, the overlap of the leaves 60 and 71 as formed by the tongue and groove arrangment tends to limit the passage of air and light between the meeting stiles of the door assembly.

While this invention has been described in detail with particular reference to a preferred embodiment thereof, it will be understood that variations and modifications can be effected within the spirit and scope of the invention as described hereinbefore and as defined in the appended claims.

We claim:

1. An astragal assembly for the meeting edges of the doors in a double swinging door installation, wherein two doors are hung on hinges in a frame and the meeting vertical edge portions of the doors each include an inner wall, an outer wall and a vertical channel formed between said inner and outer walls and extending along the door edge and facing the opposite door, the improvement therein comprising:

an elongated leaf pivotably mounted in the channel of each door and extending substantially the full height of its door, each said leaf being pivotable between a first position where the leaf protrudes out of its channel toward engagement with the leaf of the other door and a second position in which the leaf is substantially retracted into its channel;

biasing means mounted on each door for urging the leaf of each door toward its retracted position;

door stop means for mounting in the door frame of the doors at the meeting edge portions of the doors when the doors are in their closed positions for urging the leaves of the doors toward their protruding positions;

a support step on each door and extending in a plane substantially parallel to its outer wall and located adjacent its outer wall in the meeting vertical edge portion of the door;

an elongated hinge base mounted in abutment with the support step of each door and extending substantially the full height of the door; a series of hinge bosses formed on said hinge base; and said leaves each including a series of hinge bosses for alignment between the hinge bosses of a hinge base in each door and hinge pins extending through the hinge bosses of the hinge bases and their respective leaves.

2. The astragal assembly of claim 1 and wherein one of said elongated leaves defines a groove extending along its length and facing the other door when the leaves are in their protruding positions and wherein the other of said elongated leaves includes a tongue extending along its length and facing the other door when the leaves are in their protruding positions, whereby the leaves engage each other with a tongue-in-groove fit when the doors are in their closed positions.

3. The astragal of claim 1 and wherein at least one of said leaves is juxtaposed the outer wall structure of its door when the leaf is in its protruding position whereby further pivoting movement of the leaf toward the outer wall of the door is obstructed by the outer wall structure.

4. The astragal assembly of claim 1 and further including a pile strip supported adjacent the inner wall of one of said doors and extending toward the other of said doors when the doors are both in their closed positions, and a pile strip supported adjacent the outer wall of the other of said doors and extending toward the one said door when the doors are both in their closed positions.

* * * * *